US008502638B1

(12) United States Patent
Sha et al.

(10) Patent No.: US 8,502,638 B1
(45) Date of Patent: Aug. 6, 2013

(54) THERMISTOR

(75) Inventors: Yi An Sha, Xindian (TW); Chun Teng Tseng, Sanwan Township, Miaoli County (TW); David Shau Chew Wang, Tapei (TW)

(73) Assignee: Polytronics Technology Corp., Hsinchu (TW)

( * ) Notice: Subject to any disclaimer, the term of this patent is extended or adjusted under 35 U.S.C. 154(b) by 2 days.

(21) Appl. No.: 13/365,726

(22) Filed: Feb. 3, 2012

(51) Int. Cl.
*H01C 7/10* (2006.01)

(52) U.S. Cl.
USPC ..... 338/22 R; 338/13

(58) Field of Classification Search
USPC ..... 338/22 R, 13
See application file for complete search history.

(56) References Cited

U.S. PATENT DOCUMENTS 5,900,800 A * 5/1999 McGuire et al. ..... 338/22 R
6,023,403 A * 2/2000 McGuire et al. ..... 361/106
6,377,467 B1 * 4/2002 Chu et al. ..... 361/767
7,102,483 B2 * 9/2006 Hwang et al. ..... 338/22 R
7,701,322 B2 * 4/2010 Wang et al. ..... 338/22 R
8,003,216 B2 8/2011 Wang et al.
2008/0292857 A1 11/2008 Wang et al.

FOREIGN PATENT DOCUMENTS

TW 201101342 A 1/2011

* cited by examiner

*Primary Examiner* — Kyung Lee
(74) *Attorney, Agent, or Firm* — Egbert Law Offices, PLLC

(57) ABSTRACT

A thermistor includes a resistive device, a first insulation layer, a first electrode, a second electrode and a first heat-conductive layer. The resistive device includes a first electrically conductive member, a second electrically conductive member and a polymeric material layer laminated therebetween. The polymeric material layer exhibits positive temperature coefficient (PTC) or negative temperature coefficient (NTC) behavior. The first insulation layer is disposed on the first electrically conductive member. The first electrode is electrically coupled to the first electrically conductive member, whereas the second electrode is electrically coupled to the second electrically conductive member and is insulated from the first electrode. The first heat-conductive layer is disposed on the first insulation layer, and has a heat conductivity of at least 30 W/m-K and a thickness of 15-250 μm.

18 Claims, 3 Drawing Sheets

THERMISTOR

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present application relates to a surface mountable device (SMD) type thermistor such as a positive temperature coefficient (PTC) device or a negative temperature coefficient (NTC) device. It can be applied to a printed circuit board for over-current protection and abnormal ambient temperature detection.

2. Description of Related Art Including Information Disclosed Under 37 CFR 1.97 and 37 CFR 1.98.

Because the resistance of conductive composite materials having a positive temperature coefficient (PTC) characteristic is very sensitive to temperature variation, it can be used as the material for current sensing devices, and has been widely applied to over-current protection devices or circuit devices. The resistance of the PTC conductive composite material remains extremely low at normal temperature, so that the circuit or cell can operate normally. However, when an over-current or an over-temperature event occurs in the circuit or cell, the resistance instantaneously increases to a high resistance state (e.g., at least $10^2\Omega$), so as to suppress over-current and protect the cell or the circuit device.

In high density circuit design and manufacturing, it is desirable to use light, thin and downsizing surface mountable protection devices. Therefore, various surface mountable PTC devices of organic polymer are made. However, the hold currents of the PTC devices are hard to be increased due to device size limitation and poor heat transfer. Moreover, the heat insulation of the devices may cause an issue of low sensitivity to ambient temperature.

BRIEF SUMMARY OF THE INVENTION

To overcome the shortcomings of the above designs, one or more heat-conductive layers are formed on surfaces of a thermistor to increase heat conductivity, thereby increasing the hold current of the thermistor and the sensitivity to ambient temperature.

According to an embodiment of the present application, a thermistor includes a resistive device, a first insulation layer, a first electrode, a second electrode and a first heat-conductive layer. The resistive device includes a first electrically conductive member, a second electrically conductive member and a polymeric material layer laminated therebetween. The polymeric material layer exhibits PTC or NTC behavior. The first insulation layer is disposed on the first electrically conductive member, and the first insulation layer has a surface extending on a first plane. The first electrode is electrically coupled to the first electrically conductive member, whereas the second electrode is electrically coupled to the second electrically conductive member and is insulated from the first electrode. The first heat-conductive layer is disposed on the first insulation layer, and has a heat conductivity of at least 30 W/m-K and a thickness of 15-250 μm. In an embodiment, a part of the first electrode and a part of the second electrode are formed on the first plane and are associated with the first heat-conductive layer to form a major portion of a first surface of the thermistor. On the first surface the total area covered by the first electrode, the second electrode and the first heat-conductive layer is 40-90% of the area of the first surface.

In an embodiment, the thermistor may further include a second insulation layer and a second heat-conductive layer. The second insulation layer is formed on the second electrically conductive member, and has a surface extending on a second plane. The second heat-conductive layer is formed on the second insulation layer. A part of the first electrode and a part of the second electrode are formed on the second plane and are associated with the second heat-conductive layer to form a major portion of a second surface of the thermistor. On the second surface the total area covered by the first electrode, the second electrode and the second heat-conductive layer is 40-90% of the area of the second surface.

In an embodiment, one or more heat-conductive connecting members may be used to connect the first electrically conductive member and the first heat-conductive layer, or the second electrically conductive member and the second heat-conductive layer.

By improving the structure with a view to increasing the heat-conductive area or heat-conductive/electrically conductive paths of the thermistor, or by further associating with heat-transfer bond pads, the thermistor of the present application will significantly increase its heat transfer efficiency and the hold current. Moreover, the thermistor of the present application is more sensitive to ambient temperature for protections to batteries or various electronic products.

BRIEF DESCRIPTION OF THE SEVERAL VIEWS OF THE DRAWINGS

The present application will be described according to the appended drawings in which.

DETAILED DESCRIPTION OF THE INVENTION

Figure 1A:
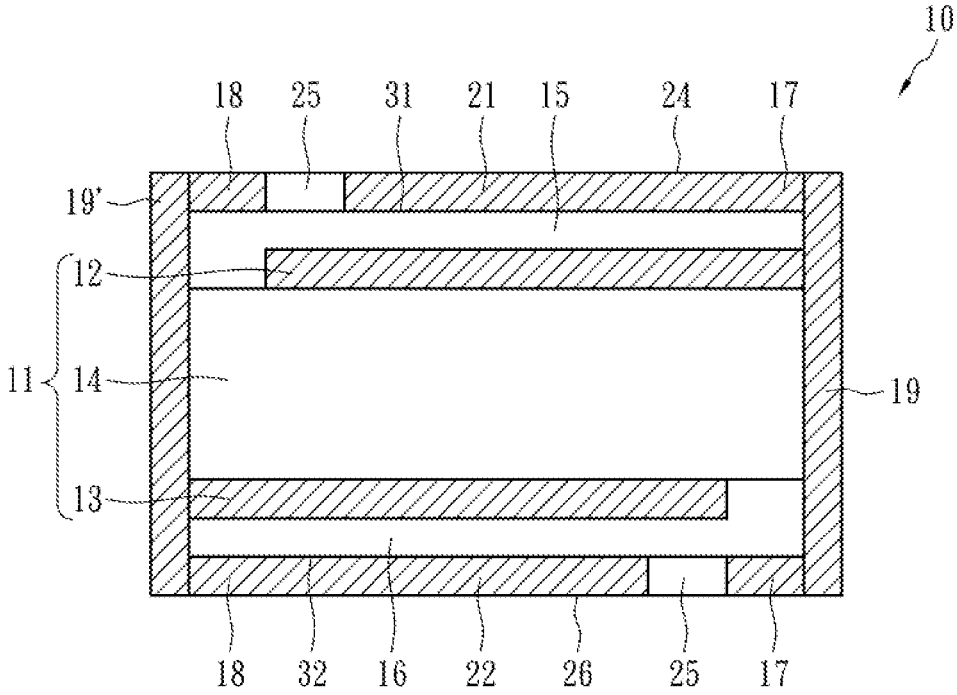
FIG. 1A and FIG. 1B show a thermistor in accordance with a first embodiment of the present application.
Figure 1B:
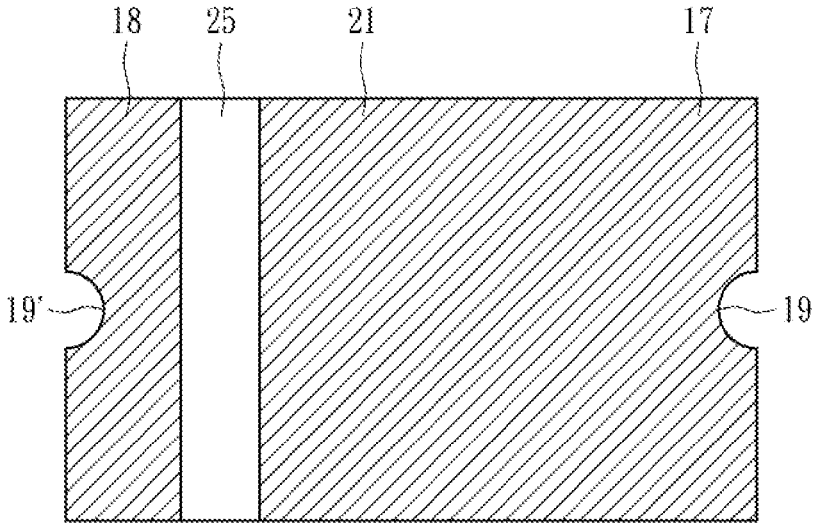

FIG. 1A shows a thermistor in accordance with a first embodiment of the present application, and FIG. 1B shows top view of the thermistor in FIG. 1A. A thermistor 10 includes a resistive device 11, a first insulation layer 15, a second insulation layer 16, a first electrode 17 and a second electrode 18. The resistive device 11 includes a first electrically conductive member 12, a second electrically conductive member 13 and a polymeric material layer 14 laminated therebetween. The polymeric material layer 14 includes electrically conductive filler and exhibits PTC or NTC behavior. In an embodiment, the polymeric material layer 14 may includes polyethylene, polypropylene, polyvinyl fluoride, the mixture or the copolymer thereof. The electrically conductive filler may include metal particles, carbon-containing particles, metal oxide, metal carbide or the mixture thereof. The first insulation layer 15 is disposed on the first electrically conductive member 12, whereas the second insulation layer 16 is disposed on the second electrically conductive member 13. The insulation layers 15 and 16 may include polypropylene, glass fibers or heat dissipation material. The heat dissipation material may be a polymer including thermosetting resin and fibers, or a polymer including interpenetrating network of thermosetting resin and thermoplastic, those are disclosed in U.S. Pat. No. 8,003,216, U.S. Pub. No. 2008/0292857, and Taiwan Pub. No. 201101342, and the disclosures of which are expressly incorporated herein by reference. The heat conductivity of the heat dissipation material is at least 0.5 W/m-K, or particularly 1 W/m-K, 2 W/m-K, 3 W/m-K, 4 W/m-K or 5 W/m-K.

A part of the first electrode 17 is disposed on a surface of the first insulation layer 15 extending on a first plane 31. Another part of the first electrode 17 is disposed on a surface of the second insulation layer 16 extending on a second plane 32. The first electrode 17 is electrically coupled to the first electrically conductive member 12 through a first electrically conductive connecting member 19. Likewise, the second electrode 18 has a part disposed on the first insulation layer 15 or the first plane 31, and has another part disposed on the second insulation layer 16 or the second plane 32. The second electrode 18 is electrically coupled to the second electrically conductive member 13 through a second electrically conductive connecting member 19', and is insulated from the first electrode 17. Compared to traditional electrodes, the first electrode 17 disposed on the first insulation layer 15 further extends toward the second electrode 18 and serves as a first heat-conductive layer 21. Likewise, the second electrode 18 disposed on the second insulation layer 16 further extends toward the first electrode 17 and serves as a second heat-conductive layer 22. In other words, the first electrode 17 can be viewed to include the first heat-conductive layer 21, and the first heat-conductive layer 21 is an extending portion of the first electrode 17. The second electrode 18 can be viewed to include the second heat-conductive layer 22, and the second heat-conductive layer 22 is an extending portion of the second electrode 18.

The first heat-conductive layer 21 and the second heat-conductive layer 22 may include nickel, copper, aluminum, lead, tin, silver, gold or the alloy thereof with a heat conductivity greater than 30 W/m-K. It is advantageous to use high heat conductivity materials such as aluminum of heat conductivity greater than 200 W/m-K (around 238 W/m-K), copper of heat conductivity greater than 300 W/m-K (around 397 W/m-K), silver or gold.

On the top and bottom surfaces of the resistive device 11, the first and second electrically conductive members 12 and 13 extend to opposite sides of the resistive device 11, respectively. Two asymmetric indentations (one indentation is generated by stripping a metal film) are formed on the left side of the first electrically conductive member 12 and on the right side of the second electrically conductive member 13 by an ordinary method such as laser trimming, chemical etching or mechanical method from a planar metal foil. Materials of the electrically conductive members 12 and 13 can be nickel, copper, zinc, silver, gold, tin, lead, the alloy thereof, or laminated material formed by the materials mentioned above. In an embodiment, the indentation can be of rectangular, semi-circular, triangular, or irregular shape. According to present application, the area of the indentation is preferably less than 25% of the total area of a surface of the electrically conductive member 12 or 13.

When the indentations are formed by stripping metal films, various adhesive films, i.e., insulations layers 15 and 16, such as an adhesive material made of epoxy and glass fiber, or further comprising polyimide, phenolic and polyester film, together with copper films are used to adhere on the upper surface and lower surface of the resistive device 11 through hot press. Afterward, electrodes 17 and 18 are formed by removing parts of the copper films by etching.

The electrode 17 on the right side and the electrode 18 on the left side can be connected by electrically conductive connecting members 19 and 19' or electroplating side surfaces. In an embodiment, a gap between the first heat-conductive layer 21 and the second electrode 18 and a gap between the second heat-conductive layer 22 and the first electrode 17 may be formed by etching for electrical insulation. The gaps are of at least 15 μm, and particularly greater than 20 μm or 30 μm.

In an embodiment, solder masks 25 are formed between the first electrode 17 and the second heat-conductive layer 22, and between the second electrode 18 and the first heat-conductive layer 21. Although solder masks 25 are rectangular in this embodiment, others like semi-circular, arc, triangular or irregular shape can be used also.

In an embodiment, the electrically conductive connecting members 19 and 19' may be semi-circular conductive holes coated with metal layers such as copper or gold layers by electroless-plating or electroplating, so as to electrically connect the upper and lower portions of the electrode 17 or 18. In addition to semi-circular shape, the cross-sections of the conductive holes may be of quarterly-circular, arc, square, diamond, rectangular, triangular or polygonal shape.

The first electrode 17, the second electrode 18 and the first heat-conductive layer 21 on a surface of the first insulation layer 15, i.e., a first plane 31, form a major portion of a first surface 24 of the thermistor 10, while the first electrode 17, the second electrode 18 and the second heat-conductive layer 22 on a surface of the second insulation layer 16, i.e., a second plane 32, form a major portion of a second surface 26 of the thermistor 10.

On the first surface 24 the total area of the first electrode 17, the second electrode 18 and the first heat-conductive layer 21 may be 40-90%, particularly 45-85% or 50-80% of the area of the first surface 24. In practice, the ratio may be 40%, 45%, 50%, 55%, 60%, 65%, 70%, 75%, 80%, 85%, 90% or 95%. Likewise, on the second surface 26 the total area of the first electrode 17, the second electrode 18 and the second heat-conductive layer 22 may be 40-90%, particularly 45-85% or 50-80% of the area of the second surface 26. In practice, the ratio may be 40%, 45%, 50%, 55%, 60%, 65%, 70%, 75%, 80%, 85%, 90% or 95%.

Figure 2A:
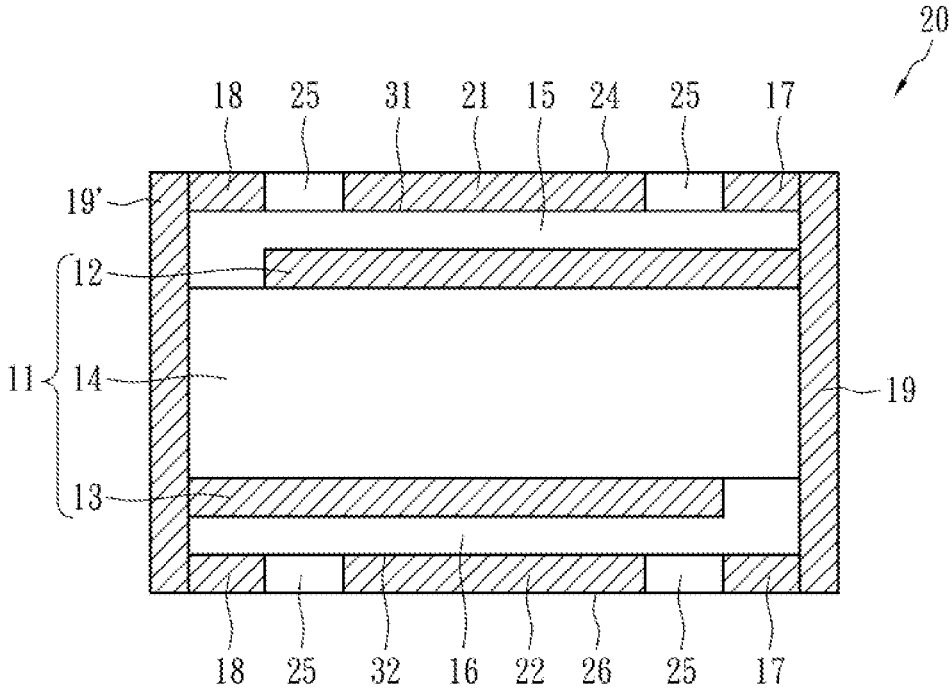
FIG. 2A and FIG. 2B show a thermistor in accordance with a second embodiment of the present application.
Figure 2B:
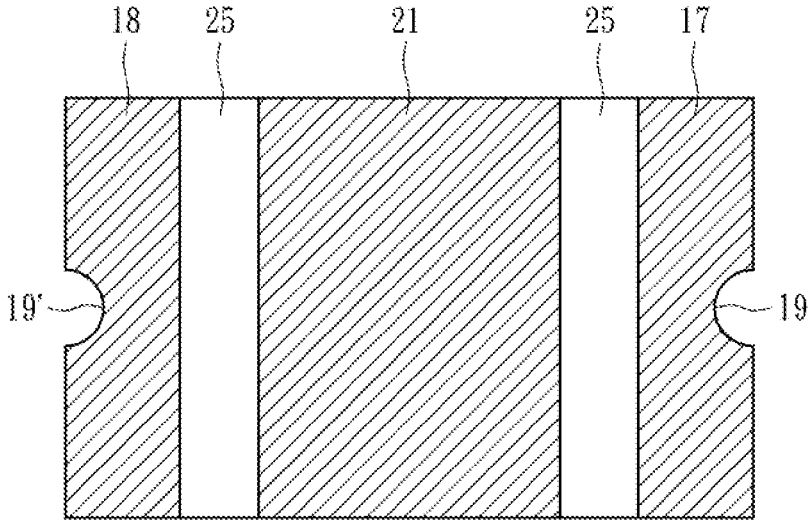

FIG. 2A shows the thermistor in accordance with the second embodiment of the present application. FIG. 2B is the top view of the thermistor shown in FIG. 2A. Like the thermistor 10 shown in FIGS. 1A and 1B, a thermistor 20 includes a resistive device 11, insulation layers 15 and 16, a first electrode 17 and a second electrode 18. The differences are that the first heat-conductive layer 21 is not an extending portion of the first electrode 17 and is singly disposed on the first insulation layer 15, and the second heat-conductive layer 22 is not an extending portion of the second electrode 18 and is singly disposed on the second insulation layer 16. In an embodiment, gaps or solder masks 25 may be formed between the first heat-conductive layer 21 and the first and second electrodes 17, 18 for insulation. Also, gaps or solder masks 25 may be formed between the second heat-conductive layer 22 and the first and second electrodes 17, 18 for insulation. The ratio of the total area of the first electrode 17, the second electrode 18 and the first heat-conductive layer 21 to the area of the first surface 24 and the ratio of the total area of the first electrode 17, the second electrode 18 and the second heat-conductive layer 22 to the area of the second surface 26 may refer to the disclosure in the first embodiment.

Figure 3:
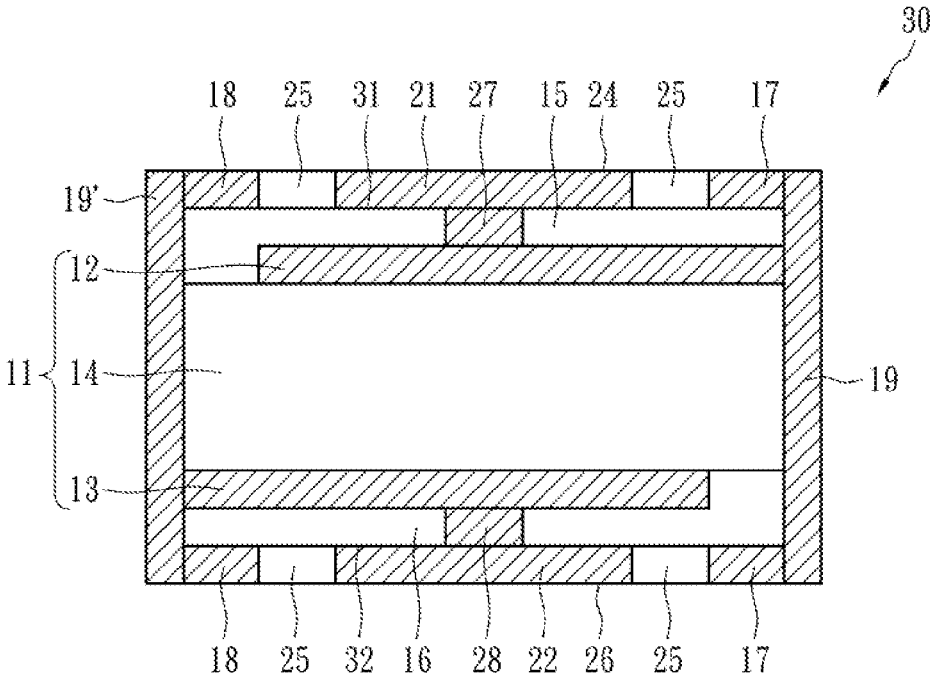
FIG. 3 shows a thermistor in accordance with a third embodiment of the present application.

FIG. 3 shows a thermistor in accordance with a third embodiment of the present application. Compared to the thermistor 20, a thermistor 30 further includes a heat-conductive connecting member 27 connecting the first heat-conductive layer 21 and the first electrically conductive member 12 to increase the heat transfer efficiency of the resistive device 11. Likewise, another heat-conductive connecting member 28 may further formed between the second heat-conductive layer 22 and the second electrically conductive member 13. The heat-conductive connecting members 27 and 28 may use the same material of the heat-conductive layers 21, 22, such as nickel, copper, aluminum, lead, tin, silver, gold or the alloy thereof with heat conductivity greater than 30 W/m-K. It is advantageous to use high heat conductivity materials such as aluminum of heat conductivity greater than 200 W/m-K, copper of heat conductivity greater than 300 W/m-K, silver, gold or the alloy thereof.

In an embodiment, the above-mentioned thermistors may include more than two resistive devices 11 connected in parallel, so as to form a multi-layer surface mountable resistive device. Moreover, the thermistors may use plural heat-conductive connecting members 27 between the first heat-conductive layer 21 and the first electrically conductive member 12 and/or plural heat-conductive connecting members 28 between the second heat-conductive layer 22 and the second electrically conductive member 13, so as to increase heat transfer efficiency.

Figure 4:
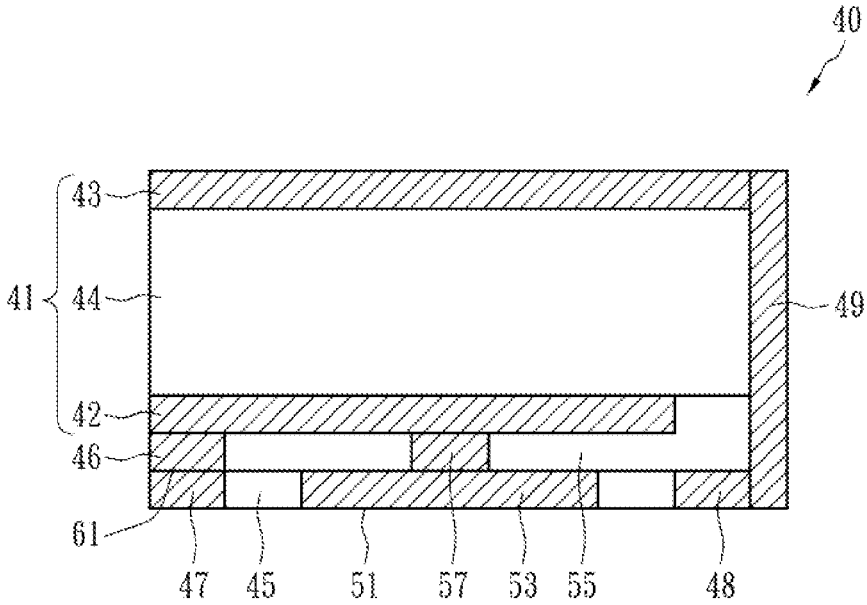
FIG. 4 shows a thermistor in accordance with a fourth embodiment of the present application.

FIG. 4 shows a thermistor in accordance with a fourth embodiment of the present application. A thermistor 40 includes a resistive device 41, an insulation layer 55, a first electrode 47 and a second electrode 48. The resistive device 41 includes a first electrically conductive member 42, a second electrically conductive member 43 and a polymeric material layer 44 laminated therebetween. The polymeric material layer 44 includes conductive filler and has PTC or NTC characteristic. The insulation layer 55 is disposed on the first electrically conductive member 42. The first electrode 47 is electrically coupled to the first electrically conductive member 42 through a conductive layer 46. The first electrode 47 is formed on a plane 61 extending from a surface of the insulation layer 55. The second electrode 48 is formed on the insulation layer 55, i.e., the plane 61, and is electrically connected to the second electrically conductive member 43 and is insulated from the first electrode 47. A heat-conductive layer 53 is formed on the surface of the insulation layer 55. In an embodiment, the heat-conductive layer 53 may be connected to the first electrically conductive member 42 through a heat-conductive connecting member 57. On the plane 61 the first electrode 47, the second electrode 48 and the heat-conductive layer 53 form a major portion of a surface 51 of the thermistor 40, and the ratio of the total area of the first electrode 47, the second electrode 48 and the heat-conductive layer 53 to the area of the surface 51 may be 40-90%, particularly 45-85% or 50-80%. In practice, the ratio can be 40%, 45%, 50%, 55%, 60%, 65%, 70%, 75%, 80%, 85%, 90% or 95%.

Other structures of surface mountable thermistors are disclosed in U.S. Pat. Nos. 6,377,467 and 7,701,322, and are expressly incorporated herein by reference. Those thermistors can further include the heat-conductive layers or heat-conductive connecting members as the above disclosures to increase the heat conductivity efficiency. Furthermore, the thickness of the heat-conductive layer may be around 15-250 μm, and particularly 18 μm, 35 μm, 70 μm, 140 μm or 210 μm. The thicker the heat-conductive layer, the better the heat conductivity efficiency is.

Compared to traditional surface mountable thermistors, the present application further adds heat-conductive layers by, for example, increasing the copper foil area, and/or adds heat-conductive connecting members such as copper columns. As a result, when the thermistor is in use, the extra heat generated by current flowing therethrough can be more efficiently transferred to circuit or the circuit board carrying the thermistor, thereby diminishing temperature augment. Due to the restriction to temperature increase, the high hold current of the thermistor can be obtained to meet the need of large current applications. Moreover, heat can be transferred more efficiently by such novel design in such a way that the thermistor will be more sensitive to ambient temperature.

The above-described embodiments of the present invention are intended to be illustrative only. Numerous alternative embodiments may be devised by persons skilled in the art without departing from the scope of the following claims.

We claim:

1. A thermistor comprising:

a resistive device comprising a first electrically conductive member, a second electrically conductive member and a polymeric material layer laminated therebetween, the polymeric material layer exhibiting positive temperature coefficient behavior;

a first insulation layer disposed on the first electrically conductive member;

a first electrode electrically coupled to the first electrically conductive member;

a second electrode electrically coupled to the second electrically conductive member and being insulated from the first electrode; and a first heat-conductive layer disposed on a surface of the first insulation layer and having a heat conductivity of at least 30 W/m-K and a thickness of between 15-250 μm, wherein the first insulation layer has a surface extending on a first plane, a part of the first electrode and a part of the second electrode are formed on the first plane and associated with the first heat-conductive layer to form a major portion of a first surface of the thermistor, a total area covered on the first surface by the first electrode and the second electrode and the first heat-conductive layer is 40-90% of an area of the first surface;

wherein a total area covered on the first surface by the first electrode and the first heat-conductive layer is greater than an area of the second electrode;

wherein a center of the first surface is covered by the first heat-conductive layer.

2. The thermistor of claim 1, wherein a total area covered on the first surface by the first electrode and the first heat-conductive layer is greater than two times an area of the second electrode.

3. The thermistor of claim 1, further comprising a second insulation layer and a second heat-conductive layer, the second insulation layer being disposed on the second electrically conductive member, and the second heat-conductive layer being disposed on the second insulation layer.

4. The thermistor of claim 3, wherein the second insulation layer has a surface extending on a second plane, a part of the first electrode, and a part of the second electrode are formed on the second plane and associated with the second heat-conductive layer to form a major portion of a second surface of the thermistor, the second surface is opposite to the first surface, a total area covered on the second surface by the first electrode and the second electrode and the second heat-conductive layer is 40-90% of an area of the second surface, a total area covered on the second surface by the second electrode and the second heat-conductive layer is greater than an area of the first electrode, a center of the second surface is covered by the second heat-conductive layer.

5. The thermistor of claim 3, wherein the first electrode and the second electrode are formed on the first insulation layer and the second insulation layer.

6. The thermistor of claim 1, wherein the first heat-conductive layer is a portion extending from the first electrode.

7. The thermistor of claim 2, wherein the first heat-conductive layer is disposed on the first plane and between the first electrode and the second electrode.

8. The thermistor of claim 1, wherein the first heat-conductive layer is insulated from the first electrode and the second electrode.

9. The thermistor of claim 8, wherein the first heat-conductive layer and the first or second electrode has a gap of at least 15 ?m therebetween.

10. The thermistor of claim 1, wherein the first heat-conductive layer is insulated from the first electrode and second electrode by solder masks.

11. The thermistor of claim 1, wherein the first heat-conductive layer is a material selected from the group consisting of nickel, copper, aluminum, lead, tin, silver, gold, and alloys thereof.

12. The thermistor of claim 1, further comprising a heat-conductive connecting member which goes through the first insulation layer and connects the first heat-conductive layer and the first electrically conductive member.

13. The thermistor of claim 12, wherein the heat-conductive connecting member has a heat conductivity of at least 30 W/m-K.

14. The thermistor of claim 12, wherein the heat-conductive connecting member is a material selected from the group consisting of nickel, copper, aluminum, lead, tin, silver, gold, and alloys thereof.

15. The thermistor of claim 1, wherein the first insulation layer is a material selected from the group consisting of polypropylene, glass fiber and heat dissipation material.

16. The thermistor of claim 1, wherein the first insulation layer has a heat conductivity of at least 0.5 W/m-K.

17. The thermistor of claim 1, further comprising a first electrically conductive connecting member and a second electrically conductive connecting member, wherein the first electrically conductive connecting member is configured to electrically connect the first electrode and the first electrically conductive member, and the second electrically conductive connecting member is configured to electrically connect the second electrode and the second electrically conductive member.

18. The thermistor of claim 2, wherein the total area covered on the first surface by the first electrode and the second electrode and the first heat-conductive layer is 50-80% of the area of the first surface.

* * * * *